US011192670B2

(12) United States Patent
Bliemel

(10) Patent No.: US 11,192,670 B2
(45) Date of Patent: Dec. 7, 2021

(54) PACKAGING SYSTEM

(71) Applicant: SOMIC Verpackungsmaschinen GmbH & Co. KG, Amerang (DE)

(72) Inventor: Josef Bliemel, Amerang (DE)

(73) Assignee: SOMIC VERPACKUNGSMASCHINEN GMBH & CO. KG, Amerang (DE)

( * ) Notice: Subject to any disclaimer, the term of this patent is extended or adjusted under 35 U.S.C. 154(b) by 543 days.

(21) Appl. No.: 15/805,234

(22) Filed: Nov. 7, 2017

(65) Prior Publication Data

US 2018/0127119 A1 May 10, 2018

(30) Foreign Application Priority Data

Nov. 8, 2016 (DE) ..... 10 2016 221 887.5

(51) Int. Cl.
*B65B 5/06* (2006.01)
*B65B 35/24* (2006.01)
(Continued)

(52) U.S. Cl.
CPC ..... *B65B 5/06* (2013.01); *B65B 5/024* (2013.01); *B65B 5/08* (2013.01); *B65B 7/16* (2013.01);
(Continued)

(58) Field of Classification Search
CPC .. B65B 5/02; B65B 5/024; B65B 5/06; B65B 5/08; B65B 11/004; B65B 11/08;
(Continued)

(56) References Cited

U.S. PATENT DOCUMENTS 6,463,713 B1 * 10/2002 Ruemeli ..... B65B 25/146 198/437
6,510,670 B1 * 1/2003 Janhonen ..... B65B 25/14 53/209
(Continued)

FOREIGN PATENT DOCUMENTS

DE 19962302 9/2001
DE 60222180 5/2008
(Continued)

OTHER PUBLICATIONS

EP Search Report filed in EP 17200610 dated Aug. 13, 2018.

*Primary Examiner* — Valentin Neacsu
*Assistant Examiner* — Jacob A Smith
(74) *Attorney, Agent, or Firm* — Rankin, Hill & Clark LLP

(57) ABSTRACT

A cyclic packaging system for packaging product groups in folded boxes includes a supply device for supplying the product groups, a store for providing a plurality of folded box blanks, and a packing device for packaging the product groups in associated folded boxes, the packing device being arranged on the side of the supply device facing the store. The packaging system further comprises an additional packing device for packing product groups in folded boxes, the additional packing device being arranged on the side of the supply device facing away from the one packing device. Irrespective of whether the two packing devices are loaded with product groups from the same supply device, the two stores of the packing devices can be arranged on the same side of the packaging systems.

12 Claims, 3 Drawing Sheets

(51) Int. Cl.

| | |
|---|---|
| ***B65B 35/50*** | (2006.01) |
| ***B65B 43/44*** | (2006.01) |
| ***B65B 5/02*** | (2006.01) |
| ***B65B 5/08*** | (2006.01) |
| ***B65B 61/28*** | (2006.01) |
| ***B65B 7/16*** | (2006.01) |
| ***B65B 41/02*** | (2006.01) |
| ***B65B 43/14*** | (2006.01) |
| ***B65B 11/00*** | (2006.01) |
| ***B65B 21/24*** | (2006.01) |
| ***B65B 65/00*** | (2006.01) |
| ***B65B 49/00*** | (2006.01) |
| ***B65B 51/02*** | (2006.01) |
| ***B65B 35/44*** | (2006.01) |
| ***B65B 43/10*** | (2006.01) |
| ***B65B 7/26*** | (2006.01) |

(52) U.S. Cl.
CPC ..... *B65B 7/26* (2013.01); *B65B 11/004* (2013.01); *B65B 21/242* (2013.01); *B65B 35/24* (2013.01); *B65B 35/44* (2013.01); *B65B 35/50* (2013.01); *B65B 41/02* (2013.01); *B65B 43/10* (2013.01); *B65B 43/145* (2013.01); *B65B 43/44* (2013.01); *B65B 49/00* (2013.01); *B65B 51/02* (2013.01); *B65B 61/28* (2013.01); *B65B 65/003* (2013.01); *B65B 65/006* (2013.01)

(58) Field of Classification Search
CPC ..... B65B 43/08; B65B 43/10; B65B 43/126; B65B 43/145; B65B 43/265; B65B 65/003; B65B 65/006
USPC ..... 53/558, 564, 566, 202
See application file for complete search history.

(56) References Cited

U.S. PATENT DOCUMENTS

| | | | | |
|---|---|---|---|---|
| 6,591,587 | B2 * | 7/2003 | Salm | B65B 25/14 53/461 |
| 6,904,733 | B2 | 6/2005 | Boix Jaen | |
| 7,434,376 | B2 * | 10/2008 | Monti | B65B 5/024 493/122 |
| 2001/0042359 | A1 * | 11/2001 | Franzaroli | B65B 57/00 53/435 |
| 2004/0031236 | A1 * | 2/2004 | Boix Jaen | B65B 21/242 53/48.8 |
| 2004/0178110 | A1 * | 9/2004 | Chandaria | B65D 75/14 206/526 |
| 2005/0055987 | A1 * | 3/2005 | White, Jr. | B65B 55/20 53/495 |
| 2005/0055988 | A1 * | 3/2005 | Escobar | B65B 5/08 53/540 |
| 2005/0217209 | A1 * | 10/2005 | Colwell | B65B 5/106 53/202 |
| 2007/0271881 | A1 * | 11/2007 | Maemura | B32B 37/20 53/558 |
| 2008/0141632 | A1 * | 6/2008 | Monti | B65B 5/024 53/566 |
| 2010/0043355 | A1 * | 2/2010 | Duperray | B65B 65/003 53/443 |
| 2010/0170202 | A1 * | 7/2010 | Bray | B65B 65/003 53/444 |
| 2011/0003028 | A1 * | 1/2011 | Onogi | B65D 5/18 426/5 |
| 2014/0202118 | A1 * | 7/2014 | Bertuzzi | B65B 5/024 53/456 |
| 2014/0223860 | A1 * | 8/2014 | Schmid | B65B 3/025 53/411 |
| 2014/0290178 | A1 * | 10/2014 | Koster | B65B 59/003 53/397 |
| 2014/0345235 | A1 * | 11/2014 | Yamazaki | B65B 57/00 53/462 |
| 2015/0027086 | A1 * | 1/2015 | Adams | B65B 5/024 53/410 |
| 2015/0224731 | A1 * | 8/2015 | Ponti | B65B 57/12 493/59 |
| 2015/0225110 | A1 * | 8/2015 | Ponti | B65D 5/2095 53/456 |
| 2015/0307218 | A1 * | 10/2015 | Rasi | B65B 35/44 53/439 |
| 2015/0321369 | A1 * | 11/2015 | Froese | B26D 11/00 53/514 |
| 2015/0329231 | A1 * | 11/2015 | Moncrief | B65B 7/18 53/443 |
| 2015/0360433 | A1 * | 12/2015 | Feijen | B31B 50/74 53/456 |
| 2015/0360801 | A1 * | 12/2015 | Sytema | B65B 43/10 53/74 |
| 2015/0367974 | A1 * | 12/2015 | Sytema | B65B 57/12 53/461 |
| 2016/0185065 | A1 * | 6/2016 | Sytema | B31B 50/52 493/180 |
| 2017/0210500 | A1 * | 7/2017 | Sytema | B65B 11/004 |

FOREIGN PATENT DOCUMENTS

| | | | | |
|---|---|---|---|---|
| EP | 1114776 | | 7/2001 | |
| EP | 1939090 | | 7/2008 | |
| GB | 2536806 | | 9/2016 | |
| GB | 2536806 | A * | 9/2016 | B65B 5/061 |
| JP | H05178328 | | 7/1993 | |
| JP | 2012116568 | | 6/2012 | |
| WO | 2010/003083 | | 1/2010 | |
| WO | 2014/117882 | | 8/2014 | |

* cited by examiner

PACKAGING SYSTEM

The invention relates to a cyclic packaging system for packaging products in folded boxes, each folded box being formed from a folded box blank and being intended for receiving a product group that is formed by a single product or a plurality of products grouped in a predetermined configuration, the packaging device comprising:

- a supply device for supplying the product groups in a main flow direction of the packaging system,
- a store for providing a plurality of folded box blanks,
- a packing device for packaging the product groups in associated folded boxes, the packing device being arranged on the side of the supply device facing the store,
- a blank transfer device for arranging at least one folded box blank taken from the store in an associated starting position of the packing device,
- a product transfer device for transferring at least one product group from the supply device to the packing device, and
- a discharge device for discharging the product groups packaged in folded boxes out of the packaging system.

Cyclic packaging systems have the advantage over continuous packaging systems that they occupy considerably less installation space. Furthermore, cyclic packaging systems are considerably more flexible in terms of the size of the folded box blanks and/or the product groups than continuous packaging systems. For this reason and also on account of their cyclic operation, cyclic packaging systems are subject to structural requirements that are completely different to those for continuous packaging systems.

In cyclic packaging systems, the products to be packaged are typically guided in a continuous product flow to a product manipulator which is connected upstream of the packaging system and in which said products are combined to form product groups having a predetermined configuration and are transferred to the supply device of the packaging system in a cyclic manner. In the context of the present invention, the product manipulator is not considered to be part of the packaging system.

In respect of a specific product group, the packaging process may proceed as follows, for example:

In a first working cycle, the product group to be packaged, which was previously arranged on the supply device by the product manipulator, is transferred into a transfer position by the supply device. At the same time, the blank transfer device takes a folded box blank from the store and arranges said blank in the starting position of the packing device.

In the next working cycle, the flat and not yet adhesively bonded folded box blank is transported from the starting position to a first packing position, and the product group is transferred from the transfer position of the supply device to the first packing position of the packing device by means of the product transfer device and arranged on the folded box blank, which is still substantially planar at this point in time. Still in the same working cycle, the folded box blank is folded around the product group to form an open box, portions of the folded box blank optionally being adhesively bonded to one another.

In the next working cycle, the open box thus formed is transported, together with the product group contained therein, to a second packing position of the packing device.

Here the box is closed in the next working cycle. Still in the same working cycle, the closed box is transferred to the discharge device.

Furthermore, packaging systems of this kind have also already been implemented in a duplex design, i.e. in a design in which two product groups and two folded box blanks each go through the working cycles simultaneously in order to increase the number of product groups packaged by the packaging system per unit of time.

In principle, embodiments are also conceivable in which three or more product groups and folded box blanks each go through the working cycles simultaneously. However, this lengthens the paths along which the product groups and folded box blanks or folded boxes have to travel in the individual working steps. Since the product groups and folded box blanks or folded boxes cannot be greatly accelerated as desired without jeopardising the predetermined configuration of the products or the desired arrangement of the folded boxes, an increase of this kind will quickly lead to a reduction in the cycle frequency, which counteracts the desire to increase efficiency.

At this juncture, it is pointed out that the features and sequences described above also apply to the packaging system according to the invention.

Depending on the product type to be packaged in question, the known packaging systems can package up to approximately 60 product groups per minute.

For the reasons explained above, it was previously necessary to provide a plurality of generic packaging systems if the aim was to increase the total output of packaged product groups above the above-mentioned limiting value of approximately 60 packaged product groups per minute. This was of course accompanied by a corresponding space requirement.

With this in mind, the object of the present invention is to provide a generic packaging system that allows the total output of packaged product groups to be increased by a predetermined factor without simultaneously having to increase the space requirement by the same factor in the process.

This object is achieved according to the invention by a generic packaging system, which further comprises an additional packing device for packing product groups in folded boxes, the additional packing device being arranged on the side of the supply device facing away from the one packing device, and in which the product transfer means is designed to also load the additional packing device with product groups.

The inventors are credited with recognising that the capacity of the supply device in the known packaging systems has not even come to close to being exhausted. As is known, a transportation unit, for example a conveyor belt, of the supply device has to be stopped while the product groups are being placed thereon by the product manipulator. The inventors have now in particular recognised that the amount of idle time in the entire duration of the working cycle is relatively small, and therefore there is such an amount of time available for accelerating the product groups, transporting them into the transfer position, and slowing them down in the transfer position that overall it is possible to supply a number of product groups that is sufficient for loading two packing devices by means of a single supply device. As a result, at a cycle frequency of the packing devices per unit of time that remains the same in comparison with the generic packaging system, it is possible to package twice as many product groups as in the case of the generic packaging system. However, since only one additional packing device has to be provided for this purpose, and not a second supply device, the space requirement increases by a factor of less than 2.

For the first time, the present invention makes it possible, by means of a cyclic packaging system, to reach a capacity range (more than 100 products packaged per minute) that was previously reserved only for continuous packaging systems, and while maintaining the high degree of flexibility in terms of size that is typical of cyclic packaging systems.

In order for the packaging system according to the invention to be just as simple to operate as the generic packaging system, in a development of the invention it is proposed for the additional store for providing folded box blanks for the additional packing device to be arranged on the same side of the supply device as the store for providing folded box blanks for the one packing device, and for the blank transfer device to be designed to also load the additional packing device with folded box blanks. In this way, the operator loading the stores with folded box blanks can stay on the same side of the packaging system and does not have to move to the other side of the packaging system to load the store associated with the additional packing device, which would involve constantly crossing the product flow at the supply or discharge side of the packaging system.

Since this concept has the above-explained advantage even if a plurality of supply devices each having a separately associated packing device are provided, irrespective of whether only one additional packing device is provided, independent protection is sought for this principle.

Since the stores for providing the folded box blanks are arranged one behind the other when viewed in the main flow direction, in a development of the two aspects of the invention it is advantageous for the starting positions of the packing devices to also be arranged one behind the other in the main flow direction. Advantageously, they could be the same distance apart as the stores. In this way, the blank transfer devices do not need to produce movement in the main flow direction. Rather, the blank transfer devices need to produce only three back-and-forth movements, namely a translational movement in the transverse direction, a translational movement in the vertical direction and a rotational movement about an axis extending substantially in parallel with the main flow direction. The transverse direction and the vertical direction extend substantially orthogonally to one another and, in each case, to the main flow direction.

In a development of the two aspects of the invention, the packing devices may also be each associated with a separate discharge device. However, it is in principle also conceivable for the packing devices to be associated with a common discharge device. The capacity of the final packaging system (s) connected downstream, for example, may determine which of the two variants is selected.

In order that the second packing positions of the two packing devices, i.e. the positions of the packing devices in which the folded boxes having the product groups arranged therein are closed, may be arranged at the same level with respect to the main flow direction in the case in which the packing devices are each associated with a separate discharge device, it is proposed for one of the packing devices to have an intermediate position, in particular an intermediate position between the first packing position and the second packing position. By means of said intermediate position, the path, which may be too long for a transfer from the first packing position to the second packing position during a single working cycle, can be divided into two sub-portions that are each covered during one working cycle.

In order to be able to keep down the number of positions of the packing devices, the transfer device may also be designed to push the product group onto a substantially flat folded box blank. The product group and the folded box blank are preferably brought together in the first packing position in which, still in the same working cycle, the folded box blank is folded around the product group to form an open box.

The transfer device may comprise, for example, two first metal sheets that extend substantially vertically and in the main flow direction. The two first metal sheets may be arranged on either side of the product group and may be movable in the transverse direction. When the product group is transferred, the trailing metal sheet pushes the product group along while the leading metal sheet stabilises the configuration of the product group when slowed down in the first packing position.

The transfer device may also comprise two second metal sheets that extend vertically and in the transverse direction. The second metal sheets can laterally guide the product group when it is transferred. In this way, when transferred by the first and second metal sheets, the product groups are surrounded on all four horizontal sides, which ensures that the predetermined configuration is maintained.

In an extension of the second metal sheets, third metal sheets may be provided in the first packing position, which extend vertically and in the transverse direction like the second metal sheets. In this way, the first and third metal sheets form, in the first packing position, a folded case around which the still open folded box is formed without the folding process being able to impact the configuration of the product group to be packaged. In order to be able to be withdrawn from the still open folded box, the first and third metal sheets are preferably vertically movable.

The packaging system according to the invention may also be implemented in a multiplex design, preferably a duplex design, i.e. in a design in which a plurality of, preferably two, product groups and a plurality of, preferably two, folded box blanks go through the working cycles simultaneously in each of the two packing devices in order to increase the number of product groups packaged by the packaging system per unit of time. For this purpose, each packing device may be associated with a plurality of stores, a plurality of blank transfer devices and a plurality of product transfer devices. Accordingly, each packing device may comprise a plurality of starting positions, a plurality of starting positions, a plurality of first packing positions and a plurality of second packing positions.

In a development of the two aspects of the invention, it may be advantageous in some applications for the product manipulator to have a time that is the length of two working cycles to prepare the product groups for processing in the packaging system. This may, for example, be the case if the predetermined configuration requires the products to be stacked on top of one another. In this case, it is advantageous for the supply device to comprise a waiting position upstream of the transfer position in the main flow direction, in which waiting position a second product group supplied, together with a first product group, towards the transfer position can be positioned during a working cycle while the first product group is being transferred out of the transfer position to the packing device by means of the product transfer device. According to this development, only in every second working cycle are the product groups thus transferred to the packaging system in order to be packaged, but twice the number thereof are transferred each time. In the process, the first product groups are directly transported into the respective transfer positions while the second product groups are transported into the waiting positions. In the next working cycle, the first product groups are subsequently transferred from the product transfer device to the packing device while the second product groups are transported out of the waiting position into the transfer position, from which they are in turn transferred to the packing device in the next working cycle.

The invention will be explained in greater detail in the following on the basis of embodiments with reference to the accompanying drawings, in which.

Figure 1:
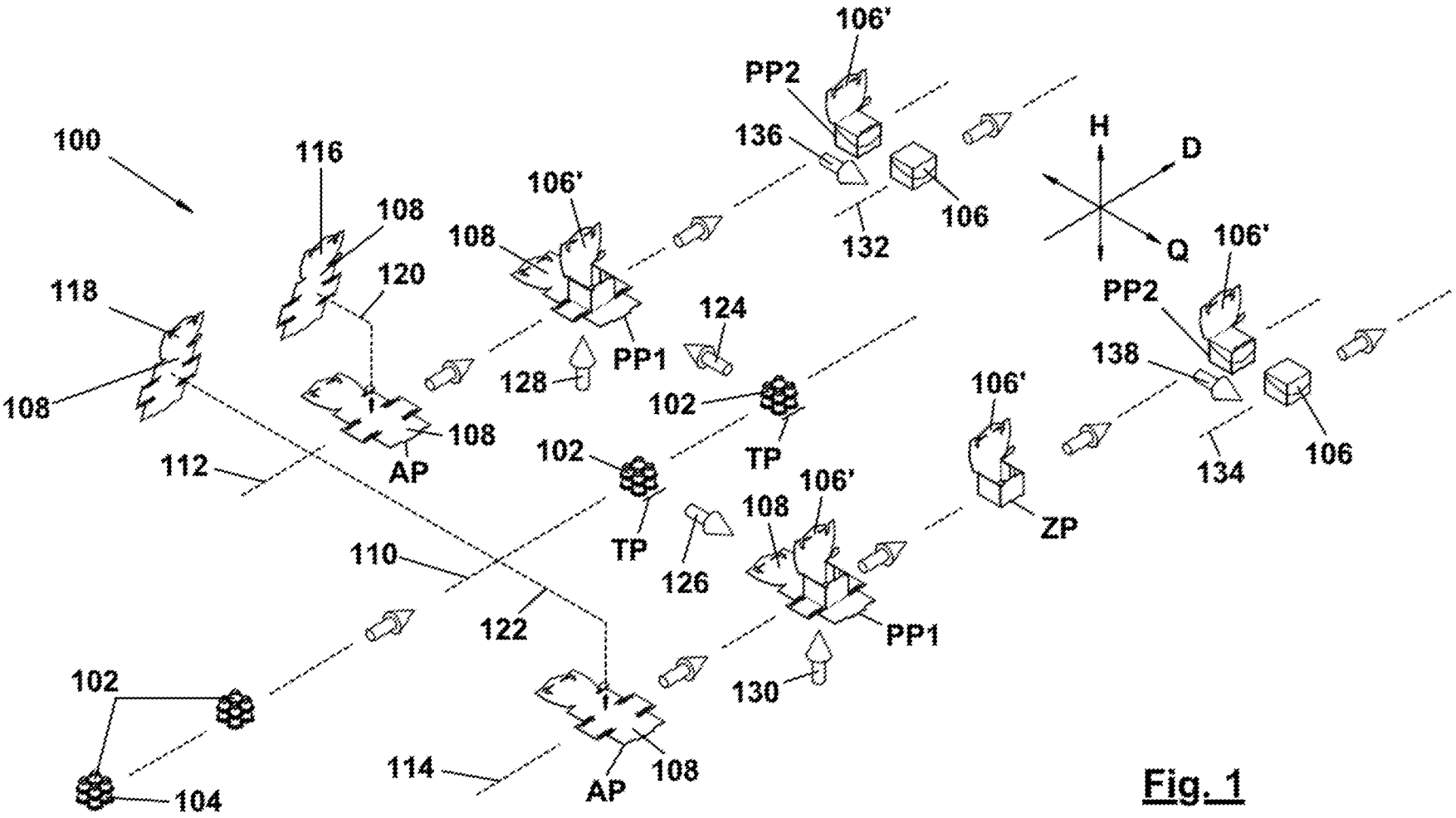
FIG. 1 is a perspective view of the flow diagram for explaining the mode of operation of a fundamental embodiment of the packaging system according to the invention.

Reference sign 100 in FIG. 1 generally denotes a first embodiment of a cyclic packaging system. The packaging system 100 is used to package product groups 102, each of which is formed from a plurality of products 104 arranged in a predetermined configuration, in folded boxes 106 that are each formed from a folded box blank 108.

The packaging system 100 comprises a supply device 110 which is indicated merely by a dashed line in FIG. 1. The supply device 110 is used to supply the product groups 102 in a main flow direction D of the packaging system 100 from a product manipulator (not shown), connected upstream of the supply device 110, to transfer positions TP. Furthermore, the packaging system 102 comprises packing devices 112 and 114, which are also indicated merely by dashed lines in FIG. 1 and, when viewed in the main flow direction D, are arranged to the left and right of the supply device 110, respectively.

On the side of the packing device 112 facing away from the supply device 110, two stores 116 and 118 are arranged in each of which a plurality of folded box blanks 108 are received. One folded box blank 108 can be taken from the store 116 and deposited in a starting position AP of the packing device 112 per working cycle by means of a blank transfer device 120, which is indicated merely by a dashed line in FIG. 1. Similarly, one folded box blank 108 can be taken from the store 118 and deposited in a starting position AP of the packing device 114 in each case by means of the blank transfer device 122.

The product groups 102 are transferred into the transfer positions TP and the folded box blanks 108 are transferred into the starting positions AP in the same working cycle.

In the next working cycle, the folded box blanks 108 are transferred from the starting position AP into a first packing position PP1. At this point, the folded box blanks 108 are still flat and not adhesively bonded. In this way, in the same working cycle the product groups 102 can be transferred, in the transverse direction Q, from the transfer position TP into the first packing position PP1, specifically such that said product groups are pushed onto the folded box blanks 108. Said transferral is carried out by means of product transfer devices 124 and 126, which are shown schematically by arrows in FIG. 1.

In the same working cycle, the folded box blanks 108 are folded by means of folding devices 128 and 130 (also shown schematically by arrows), which act from below in the vertical direction H, so as to form a still open folded box 106' in which the product group 102 is received.

In the next working cycle, the packing device 112 transports the still open folded box 106' into a second packing position PP2 in which said box is closed to form the folded box 106 and transferred to a discharge device 132. This is carried out by means of the closure device 136 indicated by an arrow.

The packing device 114 also transports the still open folded box 106' from the first packing position PP1 into a second packing position PP2; however, the still open folded box 106' makes an intermediate stop in an intermediate position ZP for one more working cycle before said box is transported to the packing position PP2, where it is closed by means of the closure device 138 and transferred to the discharge device 134.

Since the supply device 110 has sufficient capacity to load two packing devices 112 and 114 with product groups 102, it is possible to double the capacity of the packaging system 100 in comparison with a packaging system from the prior art having only one packing device, without this requiring double the amount of installation space. It is only necessary to provide a second packing device 114.

Furthermore, the two stores 116 and 118 are arranged on the same side of the packaging system 100, and therefore the operator responsible for filling the stores 116 and 118 can stay on one side of the packaging system and does not have to cross the product flow in the main flow direction D in order to fill the two stores.

Figure 2:
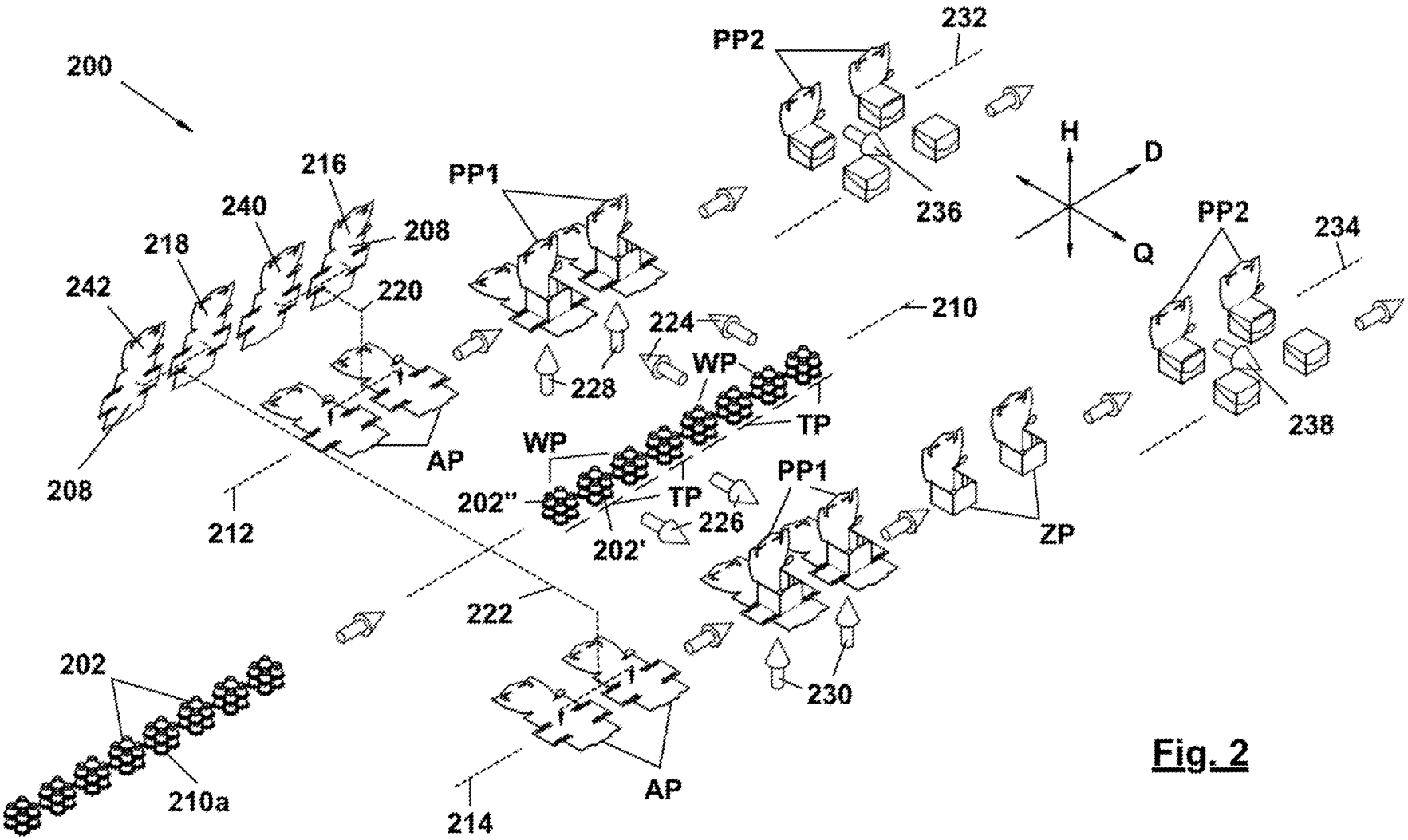
FIG. 2 is a perspective view of the flow diagram for explaining the mode of operation of a development of the packaging system according to the invention.

FIG. 2 shows another embodiment of the packaging system according to the invention that substantially corresponds to the embodiment according to FIG. 1. Therefore, in FIG. 2 similar parts are provided with the same reference signs as in FIG. 1, but increased by the number 100. Furthermore, in the following the packaging system 200 according to FIG. 2 will only be described to the extent that it differs from the embodiment according to FIG. 1, with explicit reference thus otherwise being made to the description thereof.

Like the packaging system 100, the packaging system 200 also comprises a supply device 210, packing devices 212, 214, stores 216, 218, blank transfer devices 220, 222, product transfer devices 224, 226, folding devices 228, 230, closure devices 236, 238 and discharge devices 232, 234.

A first difference between the packaging system 100 and the packaging system 200 is that the packaging system 200 is designed as a duplex system, i.e. per unit of time it is possible to process twice as many units as in the case of the packaging system 100.

For example, the blank transfer devices 220 and 222 are each designed to take folded box blanks 208 from two stores 216 and 240, and 218 and 242, respectively, and to deposit said blanks in two starting positions AP of the packing devices 212 and 214, which positions are arranged one behind the other in the main flow direction D. Furthermore, the product transfer devices 224 and 226 are each designed to transfer two product groups 202 simultaneously out of the transfer positions TP to the first packing positions PP1 of the two packing devices 212 and 214. The same also applies to the folding devices 228 and 230, the intermediate positions ZP and the second packing positions PP2.

A second difference between the packaging system 100 and the packaging system 200 is that each transfer position TP of the supply device 210 is associated with a waiting position WP. In this way, in a single transfer it is possible to transfer twice as many product groups 202 as can be further processed in one working cycle from the inlet region 210*a* of the supply device 210, which is loaded by the product manipulator (not shown), into the transfer positions TP and the waiting positions WP. In a first working cycle, the product groups 202' arranged in the transfer positions TP are forwarded to the first packing positions PP1, while the product groups 202" arranged in the waiting positions WP are forwarded to the transfer positions TP in order to be forwarded in turn to the first packing positions PP1 in the next working cycle.

In this way, the product manipulator has a time that is the length of two working cycles to prepare the product groups 202 for processing in the packaging system 200. This may be advantageous, for example, if the predetermined configuration of the product groups 202 requires the products 204 to be stacked on top of one another.

Figure 3:
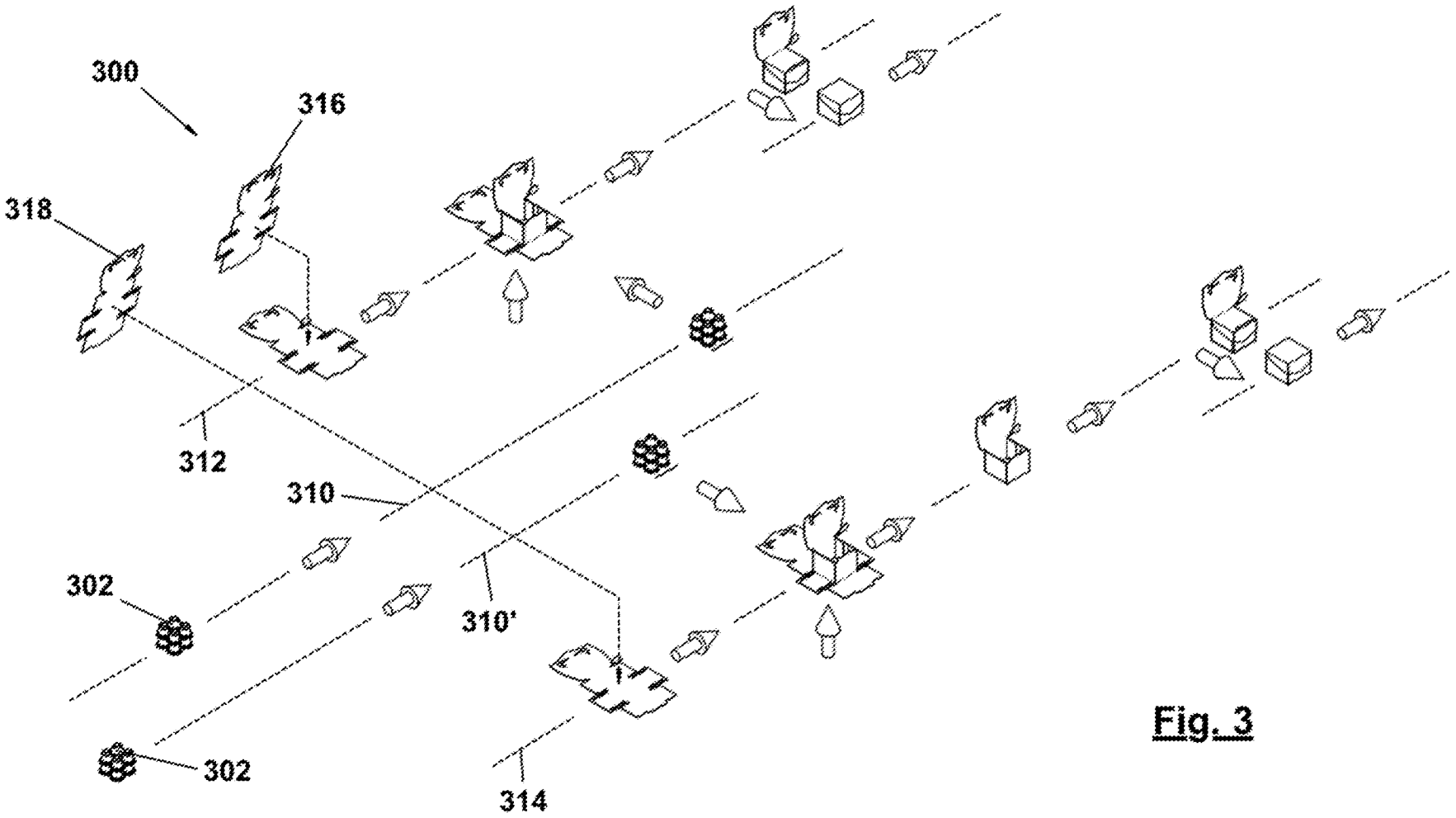
FIG. 3 is a perspective view of the flow diagram for explaining the mode of operation of a further development of the packaging system according to the invention.

FIG. 3 shows another embodiment of the packaging system according to the invention that substantially corresponds to the embodiment according to FIG. 1. Therefore, in FIG. 3 similar parts are provided with the same reference signs as in FIG. 1, but increased by the number 200. Furthermore, in the following the packaging system 300 according to FIG. 1 will only be described to the extent that it differs from the embodiment according to FIG. 1, with explicit reference thus otherwise being made to the description thereof.

The packaging system 300 in FIG. 3 differs from the packaging system 100 in that each packing device 312 and 314 is associated with a separate supply device 310 and 310', respectively, for supplying product groups 302. However, the stores 316 and 318 for loading the packing devices 312, 314 with folded box blanks 308 are arranged on the same side of the packaging system 300. In this way, the operator loading the stores 316, 318 with folded box blanks 308 can stay on the same side of the packaging system 300 and does not have to move to the other side of the packaging system 300 to load the store 318 associated with the additional packing device 314, which would involve constantly crossing the product flow at the supply or discharge side of the packaging system 300.

The invention claimed is:

1. A cyclic packaging system for packaging products in folded boxes, each folded box being formed from a folded box blank and being intended for receiving a product group that is formed by a single product or a plurality of products grouped in a predetermined configuration, the cyclic packaging system comprising:

a supply device for supplying the product groups in a main flow direction of the packaging system, a store for providing a plurality of folded box blanks, a packing device for packaging the product groups in associated folded boxes, the packing device being arranged on a side of the supply device facing the store, when viewed in the main flow direction of the packaging system, a blank transfer device for arranging at least one folded box blank taken from the store in an associated starting position of the packing device, a product transfer device for transferring at least one product group from the supply device to the packing device, a discharge device for discharging the product groups packaged in folded boxes out of the cyclic packaging system, and an additional packing device for packing product groups in folded boxes, the additional packing device being arranged on a side of the supply device facing away from the packing device, when viewed in the main flow direction of the packaging system, and the product transfer device is configured to also load the additional packing device with product groups, wherein the product transfer device is designed and intended to push the product group onto a substantially flat and non-erected folded box blank, and that the packing device and the additional packing device are designed and intended to fold the substantially flat and non-erected folded box blank around the product group to form an erected and open box, wherein an additional store for providing folded box blanks for the additional packing device is arranged on the same side of the supply device as the store for providing folded box blanks for the packing device, namely on the side of the packing device facing away from the supply device, when viewed in the main flow direction of the packaging system, and in that the blank transfer device is designed to also load the additional packing device with folded box blanks.

2. The cyclic packaging system according to claim 1, wherein the associated starting position of the packing device and a starting position of the additional packing device are arranged with the starting position of one of the packing device and the additional packing device behind the starting position of the other of the packing device and the additional packing device in the main flow direction.

3. The cyclic packaging system according to claim 2, wherein the packing device or the additional packing device has an intermediate position.

4. The cyclic packaging system according to claim 2, wherein the additional packing device is associated with an additional discharge device separate from the discharge device.

5. The cyclic packaging system according to claim 4, wherein the packing device and the additional packing device each have an intermediate position.

6. The cyclic packaging system according to claim 2, wherein the product transfer device is configured to push the product group onto a substantially flat folded box blank.

7. The cyclic packaging system according to claim 2, wherein each of the packing device and the additional packing device is associated with a plurality of stores, a plurality of blank transfer devices, and a plurality of product transfer devices.

8. The cyclic packaging system according to claim 2, wherein the supply device comprises a waiting position upstream of a transfer position in the main flow direction, in which waiting position a second product group supplied, together with a first product group, towards the transfer position can be positioned while the first product group is being transferred out of the transfer position to the packing device by the product transfer device.

9. The cyclic packaging system according to claim 1, wherein the additional packing device is associated with an additional discharge device separate from the discharge device.

10. The cyclic packaging system according to claim 1, wherein each of the packing device and the additional packing device is associated with a plurality of stores, a plurality of blank transfer devices, and a plurality of product transfer devices.

11. The cyclic packaging system according to claim 1, wherein the supply device comprises a waiting position upstream of a transfer position in the main flow direction, in which waiting position a second product group supplied, together with a first product group, towards the transfer position can be positioned while the first product group is being transferred out of the transfer position to the packing device by the product transfer device.

12. A cyclic packaging system for packaging products in folded boxes, each folded box being formed from a folded box blank and being intended for receiving a product group that is formed by a single product or a plurality of products grouped in a predetermined configuration, the cyclic packaging system comprising two packaging units, each of which comprises a supply device for supplying the product groups in a main flow direction of the packaging system, a store for providing a plurality of folded box blanks, a packing device for packaging each of the product groups in an associated folded box, a blank transfer device for arranging at least one folded box blank taken from the store in an associated starting position of the packing device, a product transfer device for transferring at least one product group from the supply device to the packing device, and a discharge device for discharging the product groups packaged in folded boxes out of the cyclic packaging system, wherein the packing devices of the two packaging units are arranged on opposite sides of the cyclic packaging system, when viewed in a main flow direction of the cyclic packaging system, wherein the stores of the two packaging units are arranged on a same side of the cyclic packaging system, namely on the side of the packing device of one of the two packaging units facing away from the supply device of the one of the two packaging units, and are arranged one behind the other, when viewed in a main flow direction of the cyclic packaging system.

* * * * *